US012428927B2

(12) United States Patent
Zhong et al.

(10) Patent No.: US 12,428,927 B2
(45) Date of Patent: Sep. 30, 2025

(54) VOLUMETRIC COMPENSATION FOR SEALING PERFORMANCE UNDER LARGE TEMPERATURE SWING CONDITIONS

(71) Applicant: Halliburton Energy Services, Inc., Houston, TX (US)

(72) Inventors: Xiaoguang Allan Zhong, Singapore (SG); Shobeir Pirayeh Gar, Plano, TX (US); Michael Linley Fripp, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 164 days.

(21) Appl. No.: 18/095,413

(22) Filed: Jan. 10, 2023

(65) Prior Publication Data

US 2024/0229594 A1 Jul. 11, 2024

(51) Int. Cl.
*E21B 33/12* (2006.01)
*E21B 33/128* (2006.01)

(52) U.S. Cl.
CPC ..... *E21B 33/1208* (2013.01); *E21B 33/128* (2013.01)

(58) Field of Classification Search
CPC ..... E21B 33/1208; E21B 33/128; E21B 23/06
See application file for complete search history.

(56) References Cited

U.S. PATENT DOCUMENTS 6,305,477 B1 10/2001 Carisella et al.
7,347,242 B2 3/2008 Agostini et al.
7,557,492 B2 7/2009 Fripp et al.
10,975,658 B2 4/2021 Zhang et al.
2010/0102518 A1* 4/2010 Gao ..... F16J 15/3236 277/554
2010/0313987 A1 12/2010 Salama et al.
2012/0125640 A1* 5/2012 Sevre ..... E21B 33/1208 166/387
2016/0068728 A1 3/2016 Akulichev et al.
2017/0191565 A1 7/2017 Cheng et al.
2017/0292611 A1 10/2017 Tanju
2019/0338854 A1* 11/2019 Lee ..... F16J 15/164
2021/0020263 A1 1/2021 Pasini et al.
2022/0090464 A1* 3/2022 Berryman ..... E21B 33/128

FOREIGN PATENT DOCUMENTS

WO 94/03743 2/1994

OTHER PUBLICATIONS

International Search Report and Written Opinion for International Patent Application No. PCT/US2023/011881 dated Sep. 20, 2023.

* cited by examiner

*Primary Examiner* — George S Gray

(74) *Attorney, Agent, or Firm* — Scott Richardson; C. Tumey Law Group PLLC

(57) ABSTRACT

Systems and methods for creating seals that expand during temperature drops. The seals may include a negative CTE material that is either internal or external to the sealing element; shape memory alloys (SMA) which exhibit negative CTE during a phase change; and/or external lattice structures with positive CTE components but negative overall CTE.

20 Claims, 11 Drawing Sheets

VOLUMETRIC COMPENSATION FOR SEALING PERFORMANCE UNDER LARGE TEMPERATURE SWING CONDITIONS

BACKGROUND

During some oilfield operations, such as water injection, downhole temperatures can drop substantially. This can have a negative impact on the performance of downhole rubber or polymeric seals, such as packer elements, bridge plugs, O-rings, and liner hangers. The main cause of this negative impact is that rubber and polymers typically have a much larger coefficient of thermal expansion (CTE) than metallic materials, such as steels. This can cause a seal, such as packer elements, which function well at nominal operating temperatures (and small variations from it); however, when the temperature drop from nominal temperatures is large, the seal may leak due to excessive shrinkage of the rubber/polymeric materials, thereby degrading the integrity of the seal.

BRIEF DESCRIPTION OF THE DRAWINGS

These drawings illustrate certain aspects of some examples of the present disclosure and should not be used to limit or define the disclosure.

DETAILED DESCRIPTION

The present disclosure relates to creating seals with materials or metamaterials that have a negative CTE (or exhibit negative CTE) to allow for volumetric compensation during large temperature swings (e.g., 200° F. to 300° F.). Examples include creating seals that include: a lattice of materials that have a normal positive CTE, a spring constructed of materials that have a negative CTE, and/or a shape memory alloy (SMA) that contracts during a phase change. The SMA has a negative CTE. The lattice exhibits negative CTE over a large temperature swing although made of positive CTE components.

In some examples, these materials/metamaterials are employed as fillers for a seal (internal compensation), thus maintaining the seal's effective overall volume during a temperature change. In other examples, the materials/metamaterials are employed as spacers (external compensation) between sealing components, backup shoes, springs, or compression retention devices. The external compensation can maintain seal performance during large temperature drop without changing the rubber components used for sealing.

The volume of the negative CTE materials (e.g., metals, plastics) will expand when the temperature drops, and can compensate volume loss due to shrinkage of the rubber/polymer (when the temperature drops) to maintain compression on the sealing elements and trapped rubber pressure. The sealing elements will shrink when the temperature rises to prevent seal element extrusion due to excessive element volume increase.

The negative CTE materials can substantially improve the robustness of the sealing component (e.g., O-ring, packer element) in downhole applications involving large temperature swings, such as during injection/production cycles. The negative CTE materials are integrated into existing components without adding additional components to the packer system or change in the current design layout.

Figure 1:
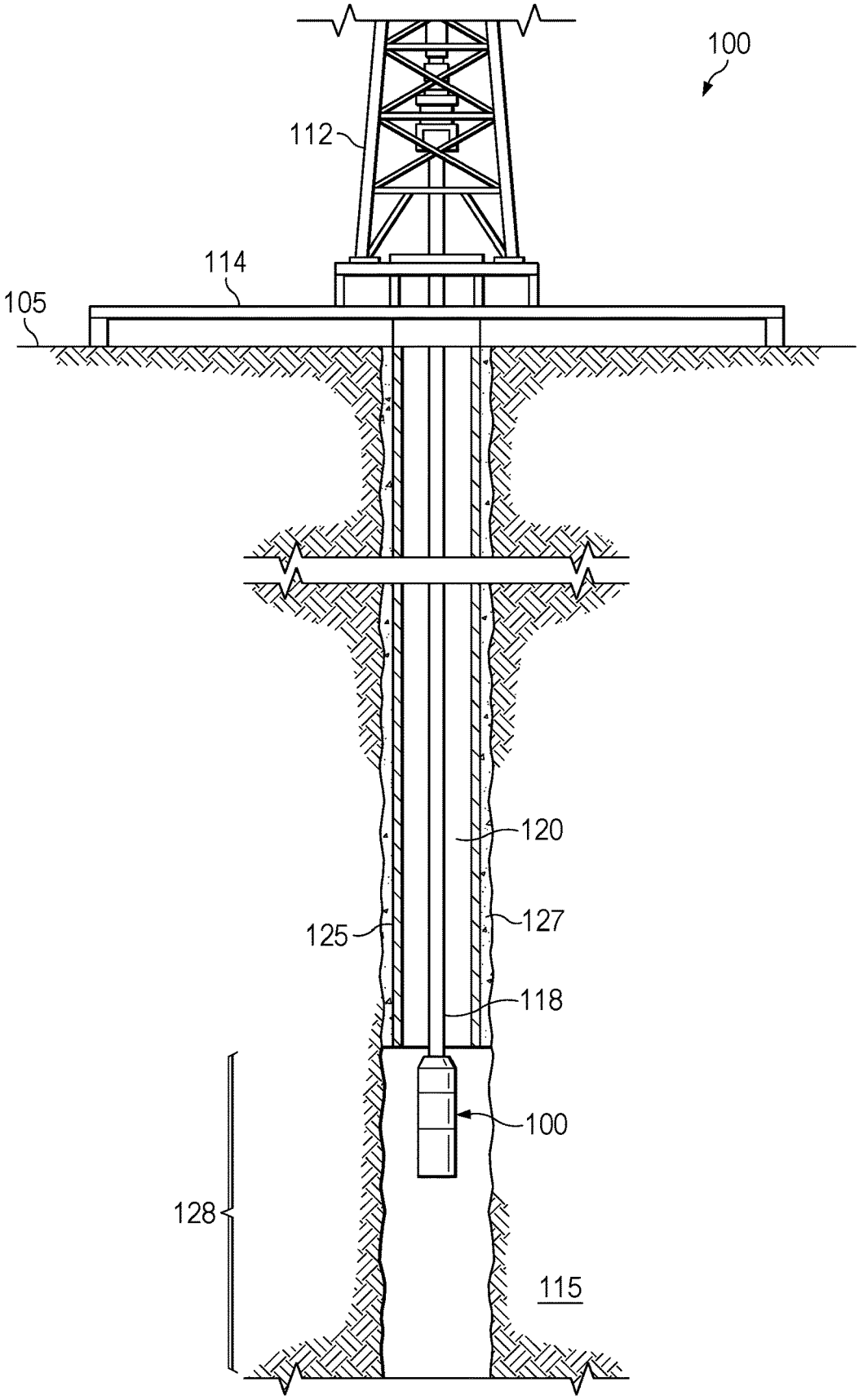
FIG. 1 illustrates an operating environment for a tool including a seal made from material(s) or metamaterial(s) exhibiting a negative coefficient of thermal expansion (CTE), in accordance with examples of the present disclosure.

FIG. 1 illustrates a well system 110 (operating environment) for a downhole tool 100, in accordance with examples of the present disclosure. In some examples, the downhole tool 100 may include a bridge plug, vee packing, a seal gland, and/or a packing seal. A derrick 112 with a rig floor 114 is positioned on the earth's surface 105. A wellbore 120 is positioned below the derrick 112 and the rig floor 114 and extends into a subterranean formation 115. The wellbore 120 may be lined with casing 125 that is cemented in place with cement 127. Although FIG. 1 depicts the wellbore 120 having a casing 125 being cemented into place with cement 127, the wellbore 120 may include open hole portion 128. Moreover, the wellbore 120 may be an open-hole wellbore. The well system 110 may equally be employed in vertical and/or deviated wellbores.

A tool string 118 extends from the derrick 112 and the rig floor 114 downwardly into the wellbore 120. The tool string 118 may be any mechanical connection to the surface, such as, for example, wireline, slickline, jointed pipe, or coiled tubing. As depicted, the tool string 118 suspends the downhole tool 100 for placement into the wellbore 120 at a desired location to perform a specific downhole operation. In some examples, the downhole tool 100 may be hydraulically pumped into the wellbore 120. In some examples, the downhole tool 100 may include any type of wellbore zonal isolation device including, but not limited to, a frac plug, a bridge plug, a packer, a wiper plug, or a cement plug.

Figure 2A:
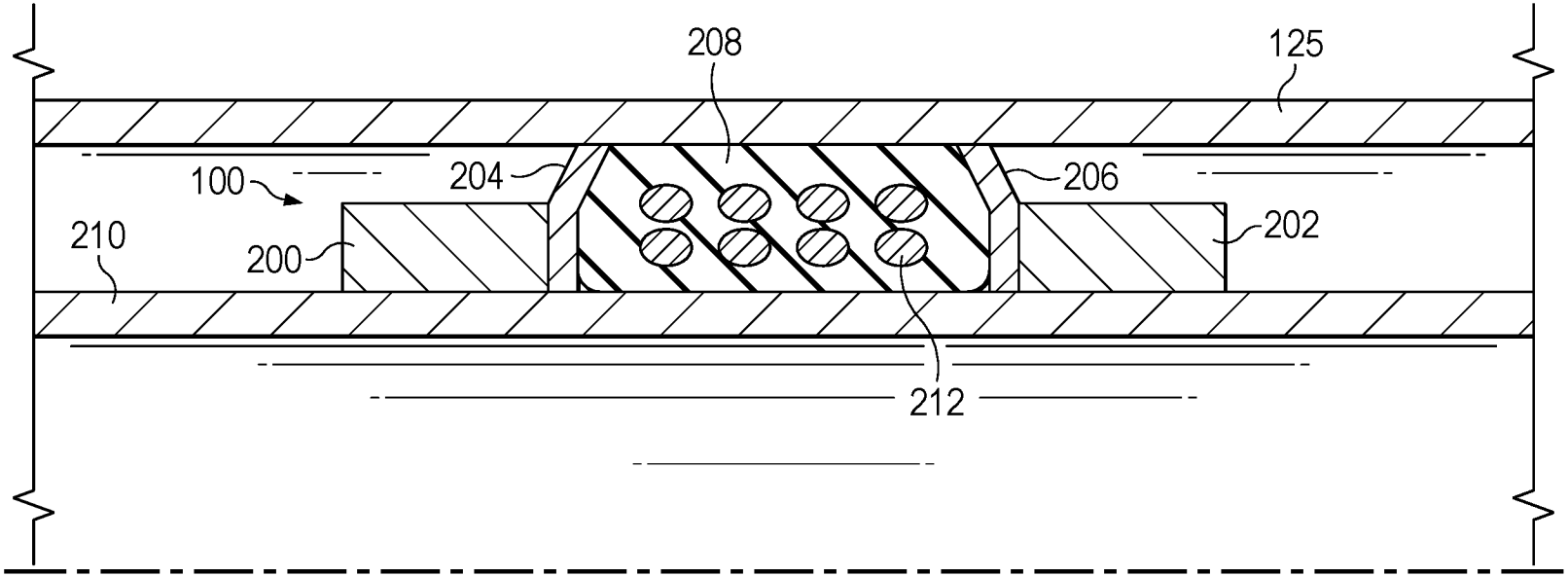
FIG. 2A illustrates an internal compensation sealing configuration that includes negative CTE fillers, in accordance with examples of the present disclosure.

FIG. 2A illustrates an internal compensation sealing configuration that includes negative CTE fillers, in accordance with examples of the present disclosure. Each of the components of the tool 100 may extend along a circumference of the tool 100 (e.g., tubular tool), however only a portion of the tool 100 is shown disposed in the casing 125 (or open hole). The tool 100 may include a first wedge 200 and a second wedge 202. Adjacent to each of the wedges, respectively, are a first back-up shoe 204 and a second back-up shoe 206.

A sealing element 208 (e.g., rubber/polymer) may be disposed between the back-up shoes. The tool 100 also includes a mandrel 210 such that the sealing element 208 is confined by the back-up shoes, a portion of the casing 125, and a portion of the mandrel 210. Negative CTE material 212 (e.g., fillers) may be disposed (e.g., embedded) within the sealing element 208. When temperature drops, rubber sealing components shrink, but the negative CTE material 212 grows, and thus can maintain the compression force on the sealing element 208. These volume growths all help to compensate the shrinkage of sealing components, and thus maintain the pressure in sealing components, maintain its sealing performance during temperature swings. A similar approach can be applied to O-rings to maintain its low temperature performance by maintaining a squeeze on it via volume compensation from spacers with negative CTE.

Figure 2B:
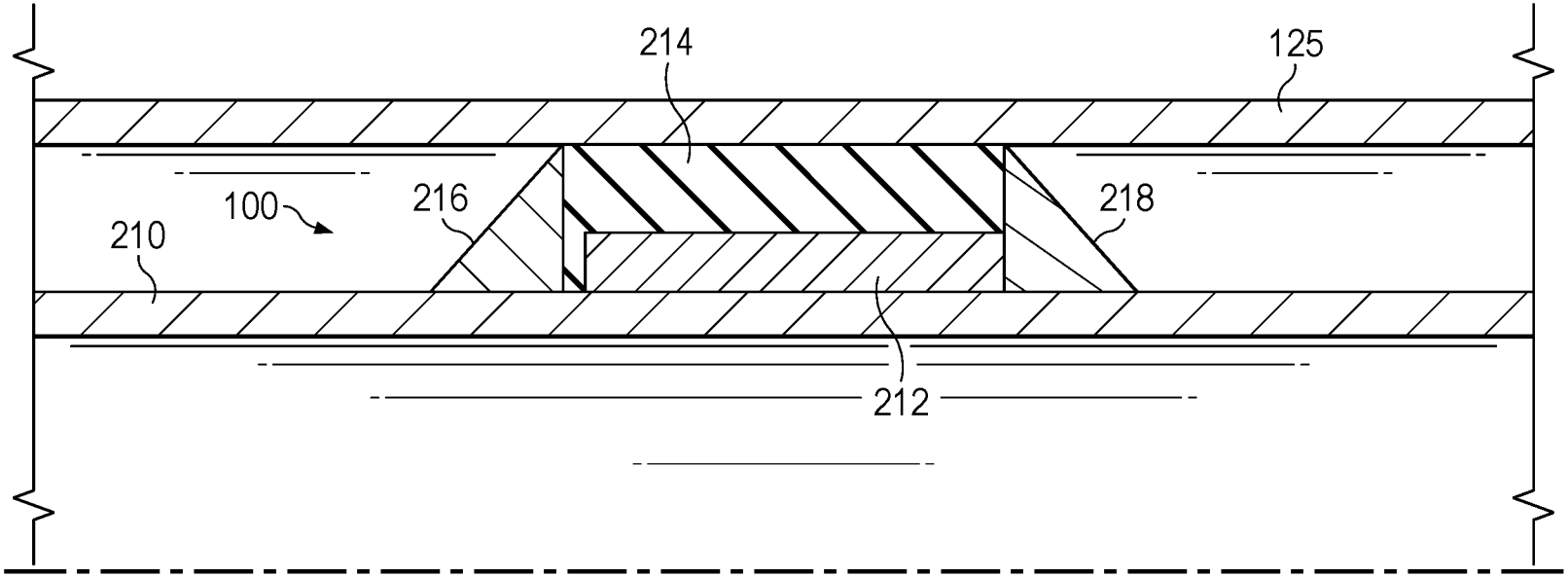
FIG. 2B illustrates an internal compensation sealing configuration that includes a negative CTE filler in a sealing element, in accordance with examples of the present disclosure.

FIG. 2B illustrates an internal compensation sealing configuration that includes a negative CTE filler in a sealing element, in accordance with examples of the present disclosure. Each of the components of the tool 100 may extend along a circumference of the tool 100 (e.g., tubular tool), however only a portion of the tool 100 is shown disposed in the casing 125 (or open hole). The tool 100 may include a sealing element 214 for use in expandable liner hanger (ELH) applications. The negative CTE material 212 may be disposed/embedded within the sealing element 214, as shown. The negative CTE material 212 may be disposed in continuous or discrete patterns around the mandrel 210. The sealing element 214 may be disposed between a first spike 216 and a second spike 218 of the tool 100 which may include an ELH.

Figure 2C:
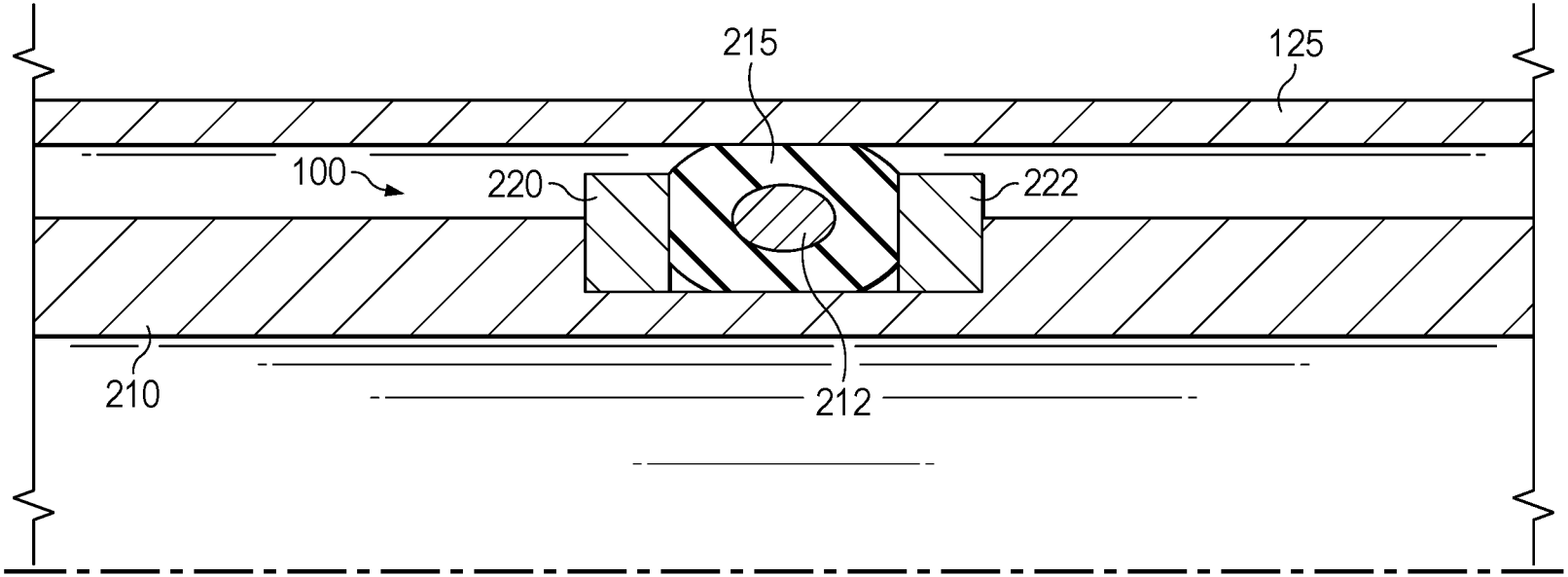
FIG. 2C illustrates an internal compensation sealing configuration that includes spacers and a negative CTE filler in an O-ring, in accordance with examples of the present disclosure.

FIG. 2C illustrates an internal compensation sealing configuration that includes spacers and a negative CTE filler in an O-ring, in accordance with examples of the present disclosure. Each of the components of the tool 100 may extend along a circumference of the tool 100 (e.g., tubular tool), however only a portion of the tool 100 is shown disposed in the casing 125 (or open hole). The tool 100 may include the O-ring 215 disposed between a first spacer 220 (e.g., metal spacer) and a second spacer 222, for use in expandable liner hanger (ELH) applications. The negative CTE material 212 may be disposed/embedded within the O-ring 215, as shown. The negative CTE material 212 may be disposed in continuous or discrete patterns around the mandrel 210.

Figure 3:
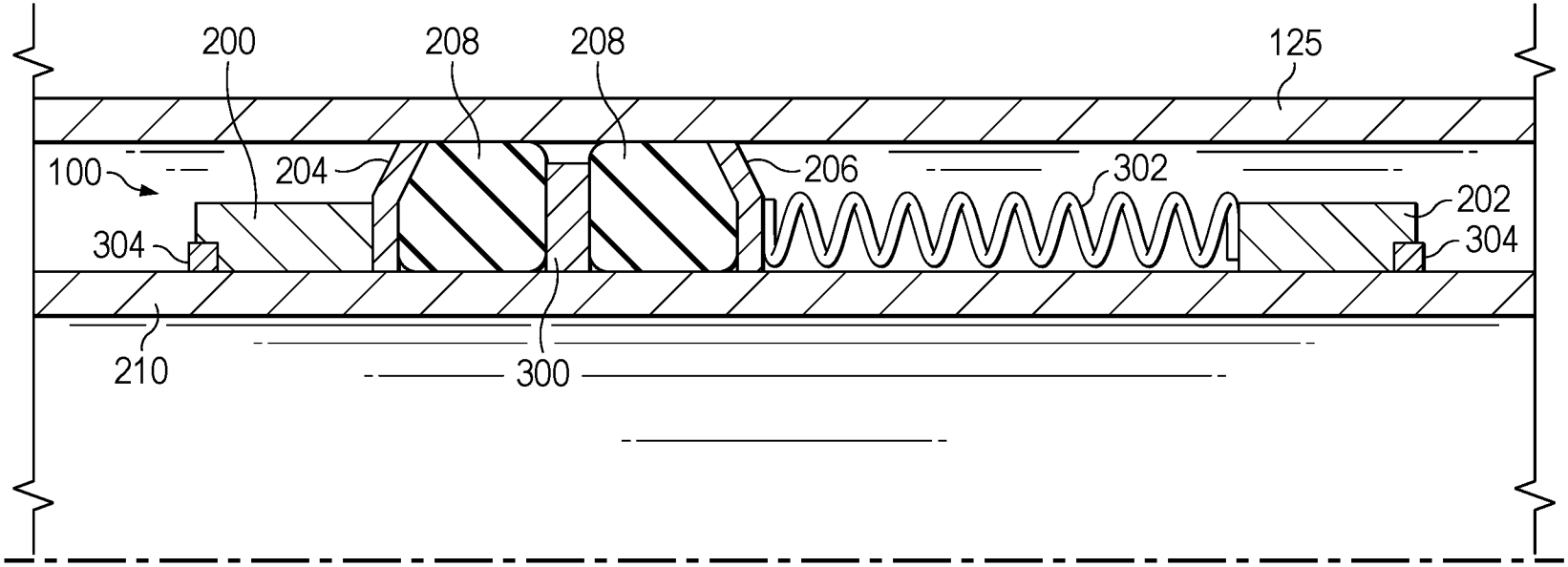
FIG. 3 illustrates an external compensation sealing configuration that includes a negative CTE spring and a negative CTE spacer, in accordance with examples of the present disclosure.

FIG. 3 illustrates an external compensation sealing configuration that includes a spring and a spacer, in accordance with examples of the present disclosure. This configuration may be employed in a packer or bridge plug design. Each of the components of the tool 100 may extend along a circumference of the tool 100 (e.g., tubular tool), however only a portion of the tool 100 is shown disposed in the casing 125 (or open hole).

Sealing elements 208 may be disposed between the first back-up shoe 204 and the second back-up shoe 206. A metallic spacer 300 with a negative CTE is disposed between the sealing elements 208. The sealing elements 208 and the spacer 300 are confined by the casing 125 and the mandrel 210. The first wedge 200 is adjacent to the first back-up shoe 204, and the second wedge 202 is adjacent to a metallic member 302 (spring or solid elastic sleeve) that has a negative CTE. The member 302 is disposed between the second back-up shoe 206 and the second wedge. Each of the wedges are stationary (e.g., each locked in place with an internal slip 304). In some examples, the metallic spring may be constructed from a lattice of struts where each of the struts has a positive CTE.

Figure 4:
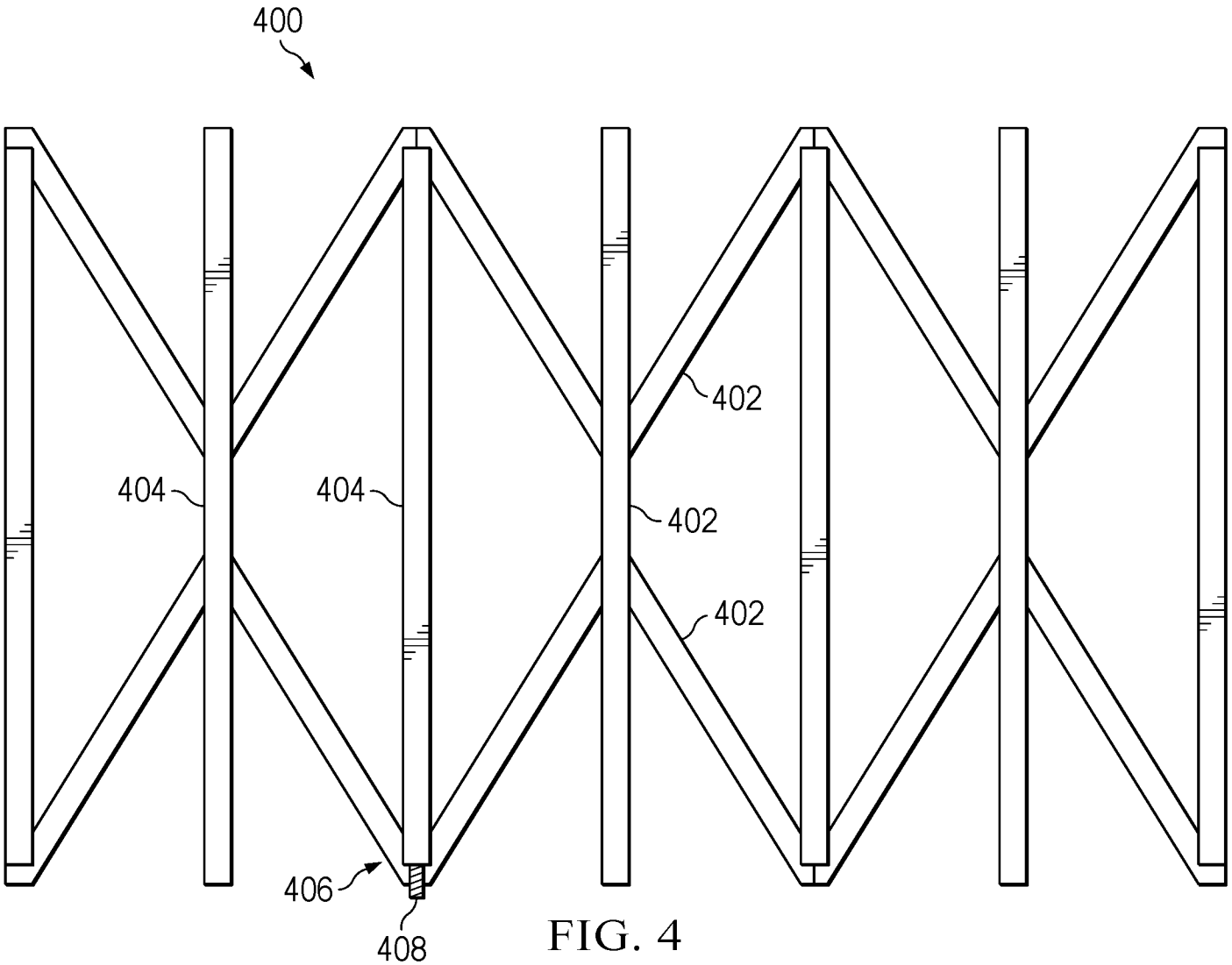
FIG. 4 illustrates a lattice structure exhibiting negative CTE behavior, in accordance with examples of the present disclosure.

FIG. 4 illustrates an example of an external spring lattice 400 with negative CTE. The lattice 400 exhibited a CTE of $-70\times10^{-6}$° C. over a temperature ranging from 0° C. to 200° C. The lattice 400 may include titanium segments 402 and aluminum segments 404. The segments are connected via an interference fit 406 and are fastened with a screw 408. The lattice exhibits negative CTE over a large temperature swing although made of positive CTE components.

Figure 5:
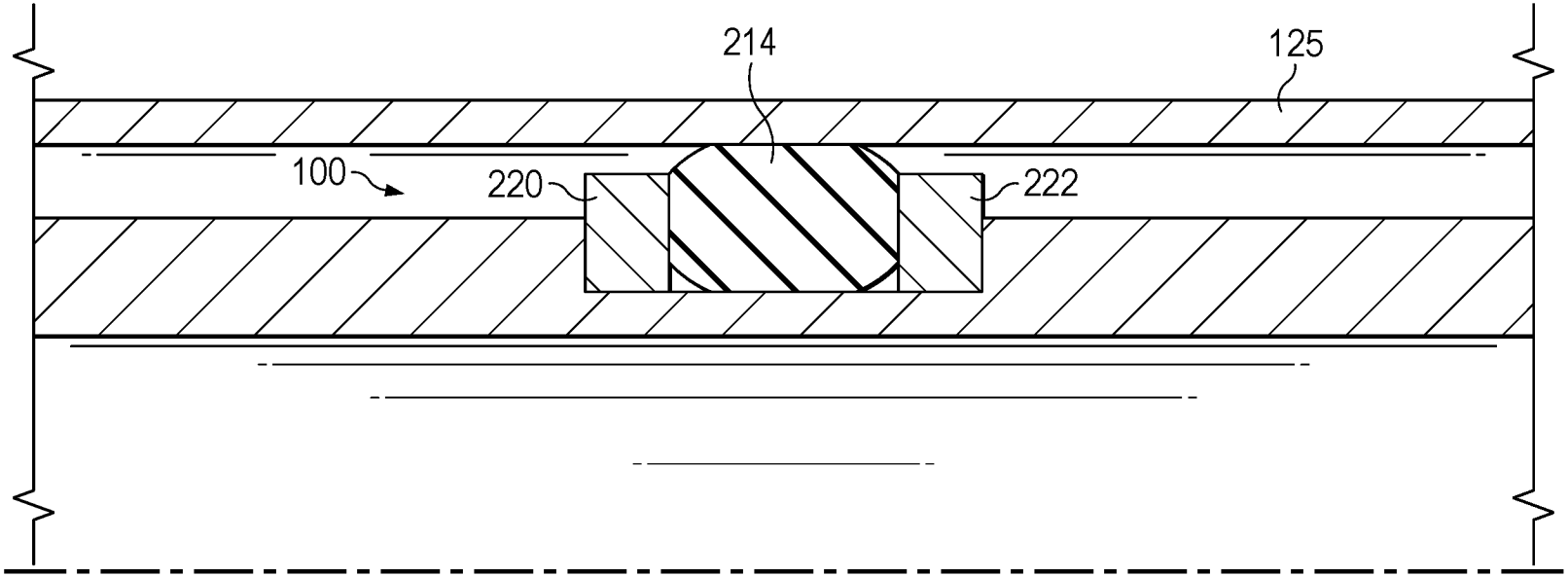
FIG. 5 illustrates an external compensation sealing configuration including spacers made of negative CTE materials, in accordance with examples of the present disclosure.

FIG. 5 illustrates an external compensation sealing configuration including spacers made of negative CTE materials, in accordance with examples of the present disclosure. Each of the components of the tool 100 may extend along a circumference of the tool 100 (e.g., tubular tool), however only a portion of the tool 100 is shown disposed in the casing 125 (or open hole). The tool 100 may include the O-ring 214 disposed between the first spacer 220 and the second spacer 222, for use in any downhole sealing requirements that need O-Rings, for example expandable liner hanger (ELH) applications. The spacers may be made of the negative CTE material.

Some examples use the SMA or other phase changing alloys to achieve volumetric compensation in sealing device during large temperature swing and thus maintaining a sealing device's performance during the temperature cycle. The phase transformation induced by the temperature change in SMA reverses the deformation known as the shape memory effect (SME). The effect can be one-way or two-way. The two-way shape memory effect allows the material to remember two shapes: one at the high temperature, and one at the low temperature. The material can be trained to increase the length at low temperature.

As an example, the beam spring of FIG. 3 can be replaced with two-way shape-memory material to increase the length at low temperature and compensate for the volume loss due to shrinkage of the seal element. Or alternatively, the beam spring can be combined with a two-way shape-memory material bar to form a bias spring to increase the length when temperature drops.

Figure 6A:
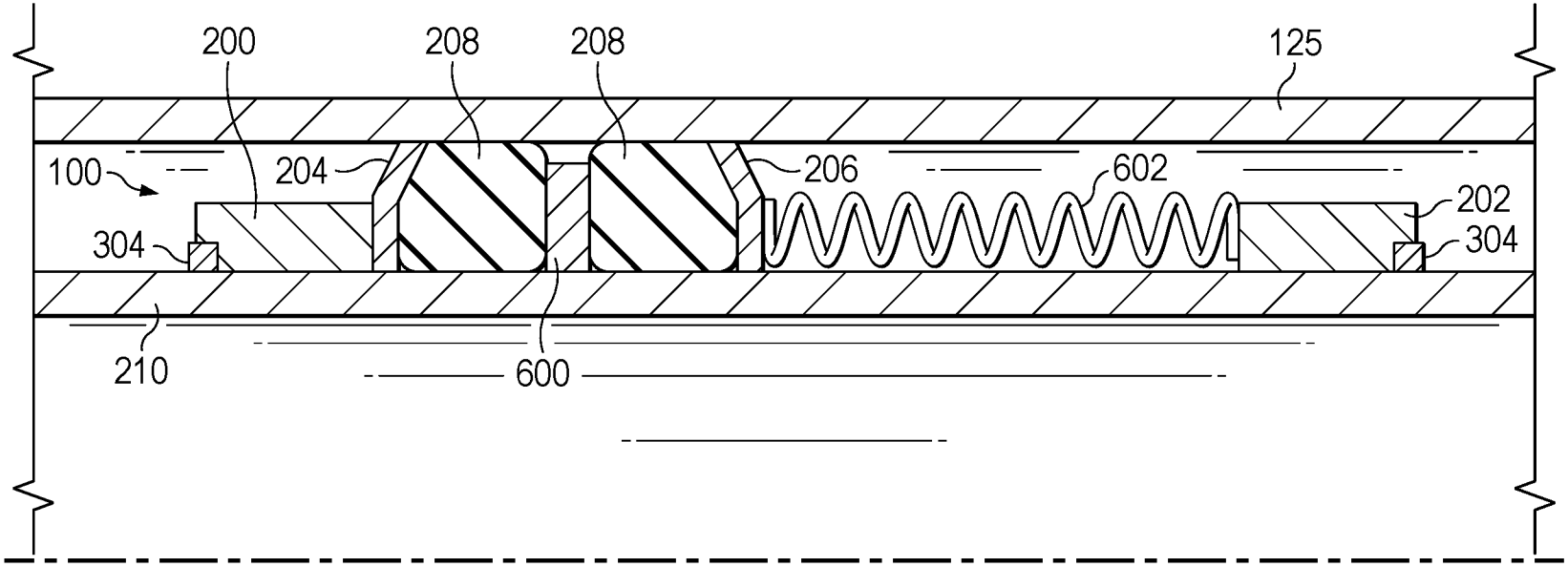
FIG. 6A illustrates an external compensation sealing configuration including a shape memory alloy (SMA) spring, in accordance with examples of the present disclosure.

FIG. 6A illustrates an external compensation sealing configuration including an SMA member, in accordance with examples of the present disclosure. This configuration may be employed in a packer or bridge plug design. Each of the components of the tool 100 may extend along a circumference of the tool 100 (e.g., tubular tool), however only a portion of the tool 100 is shown disposed in the casing 125 (or open hole).

Sealing elements 208 may be disposed between the first back-up shoe 204 and the second back-up shoe 206. A spacer 600 is disposed between the sealing elements 208. The sealing elements 208 and the spacer 600 are confined by the casing 125 and the mandrel 210. The first wedge 200 is adjacent to the first back-up shoe 204, and the second wedge 202 is adjacent to SMA member 602 (e.g., a spring or a solid elastic sleeve) that has a negative CTE and is a two-way SMA. The member 602 is disposed between the second back-up shoe 206 and the second wedge. Each of the wedges are stationary (e.g., each locked in place with an internal slip 304).

Examples of the SMA include MnCoGe alloys which have volume increase during the temperature drop. The MnCoGe-based compounds undergo a giant negative thermal expansion during the martensitic structural transition from hexagonal to orthorhombic structure. In the region near room temperature, these compounds exhibit −119×10-6/° C. In one example, the MnCoGe alloy is mixed with a polymer binder to create a more stable material with negative CTE.

Figure 6B:
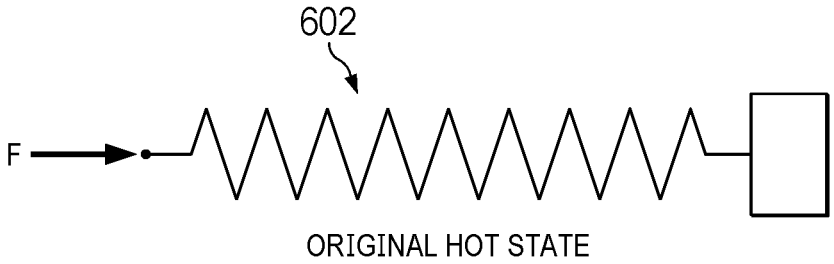
FIG. 6B illustrates an original hot state of the SMA spring, in accordance with examples of the present disclosure.
Figure 6C:
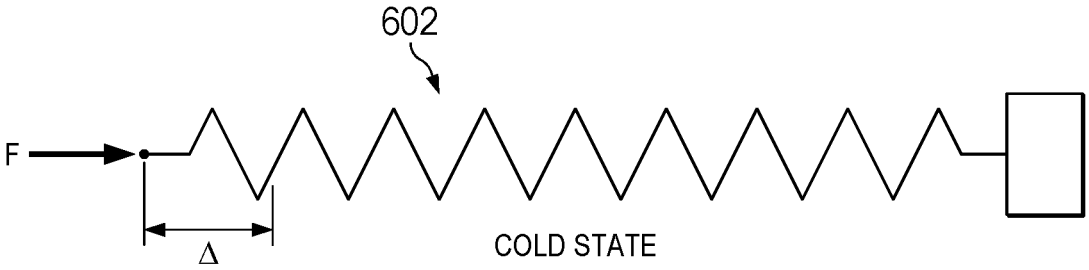
FIG. 6C illustrates a cold state of the SMA spring, in accordance with examples of the present disclosure.

FIG. 6B illustrates an original hot state of the SMA member 602. F is a force exerted on the sealing element of the tool. As illustrated, during the hot state, the member 602 is compressed/shortened. FIG. 6C illustrates the cold state of the SMA member 602. F is the force exerted on the sealing element of the tool. During the cold state, the SMA member 602 is expanded/lengthened.

Figure 7A:
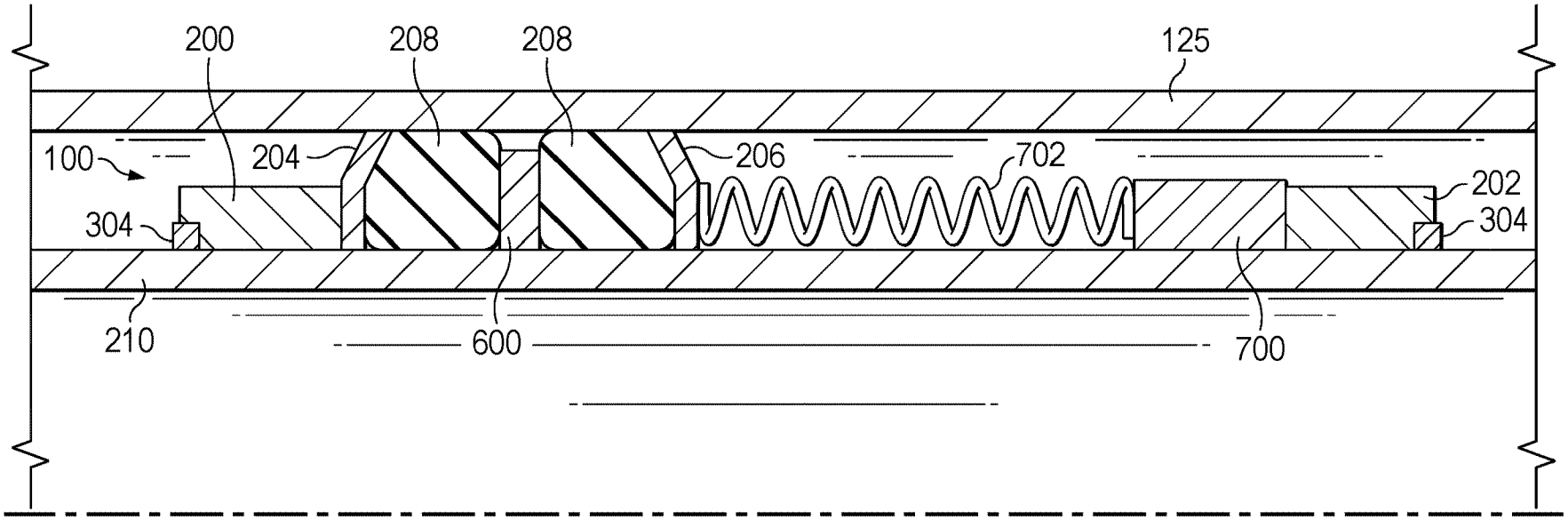
FIG. 7A illustrates an external sealing configuration including a beam spring combined with an SMA member/bar, in accordance with examples of the present disclosure.

FIG. 7A illustrates an external sealing configuration including a beam spring combined with an SMA bar, in accordance with examples of the present disclosure. This configuration may be employed in a packer or bridge plug design. Each of the components of the tool 100 may extend along a circumference of the tool 100 (e.g., tubular tool), however only a portion of the tool 100 is shown disposed in the casing 125 (or open hole). Sealing elements 208 may be disposed between the first back-up shoe 204 and the second back-up shoe 206.

A spacer 600 is disposed between the sealing elements 208. The sealing elements 208 and the spacer 600 are confined by the casing 125 and the mandrel 210 and the back-up shoes. The first wedge 200 is adjacent to the first back-up shoe 204, and the second wedge 202 is adjacent to a two-way shape-memory material bar 700 (e.g., member, sleeve) to form a bias spring to increase the length when temperature drops. A conventional beam spring 702 (e.g., positive CTE) can be combined with the SMA member (bar 700). The spring 702 is disposed between the second back-up shoe 206 and the bar 700. Each of the wedges are stationary (e.g., each locked in place with an internal slip 304).

Figure 7B:
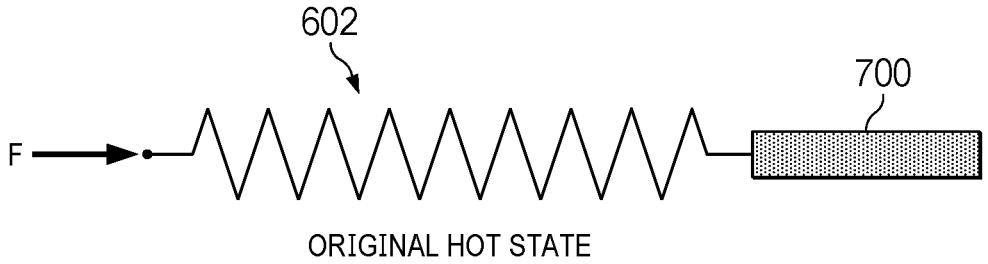
FIG. 7B illustrates an original hot state of the SMA bar, in accordance with examples of the present disclosure.
Figure 7C:
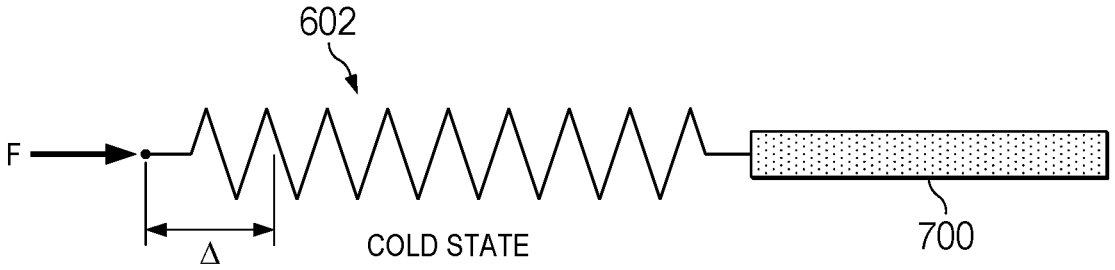
FIG. 7C illustrates a cold state of the SMA bar, in accordance with examples of the present disclosure.

FIG. 7B illustrates an original hot state of the bar 700. F is a force exerted on the sealing element of the tool. As illustrated, during the hot state, the bar 700 is compressed/shortened. FIG. 7C illustrates the cold state of the bar 700. F is the force exerted on the sealing element of the tool. During the cold state, the bar 700 is expanded/lengthened.

Accordingly, the systems and methods of the present disclosure allow for increasing the squeeze within an elastomer as the seal is cooled. This additional squeeze can be provided with a negative CTE material within the elastomer or with a negative CTE spring providing a force onto the rubber. The systems and methods may include any of the various features disclosed herein, including one or more of the following statements.

Statement 1. A downhole tool comprising: a sealing element: and a member with a negative coefficient of thermal expansion (CTE), the member configured to expand the sealing element during a temperature drop, wherein the member is external to the sealing element.

Statement 2. The downhole tool of the statement 1, wherein the sealing element is disposed between back-up shoes.

Statement 3. The downhole tool of the statement 1 or the statement 2, wherein the member is adjacent to one back-up shoe.

Statement 4. The downhole tool of any one of the statements 1-3, further comprising a spacer that is adjacent to the sealing element.

Statement 5. The downhole tool of any one of the statements 1-4, further comprising a wedge adjacent to the member.

Statement 6. The downhole tool of any one of the statements 1-5, further comprising a slip adjacent to the wedge.

Statement 7. The downhole tool of any one of the statements 1-6, wherein the member extends between the wedge and the one back-up shoe.

Statement 8. The downhole tool of any one of the statements 1-7, wherein the member is external to the back-up shoes.

Statement 9. The downhole tool of any one of the statements 1-8, wherein the member includes a spring or a spacer.

Statement 10. The downhole tool of any one of the statements 1-9, wherein the member includes a shape memory alloy.

Statement 11. The downhole tool of any one of the statements 1-10, further comprising a spring adjacent to the member.

Statement 12. A downhole tool comprising a sealing element and a lattice structure including segments, each segment having a positive coefficient of thermal expansion (CTE), the lattice structure configured to expand the sealing element during a temperature drop.

Statement 13. The downhole tool of the statement 12, wherein the lattice structure is external to the sealing element.

Statement 14. The downhole tool of any one of the statements 12 or 13, wherein the sealing element is disposed between back-up shoes.

Statement 15. The downhole tool of any one of the statements 12-14, wherein the lattice structure is adjacent to one back-up shoe.

Statement 16. The downhole tool of any one of the statements 12-15, further comprising a spacer that is adjacent to the sealing element.

Statement 17. The downhole tool of any one of the statements 12-16, further comprising a wedge adjacent to the lattice structure.

Statement 18. A downhole tool comprising a sealing element: and a member including a shape memory alloy (SMA), the SMA configured to expand the sealing element during a temperature drop.

Statement 19. The downhole tool of the statement 18, wherein the SMA is external to the sealing element.

Statement 20. The downhole tool of any one of the statements 18 or 19, further comprising a spring adjacent to the SMA.

Statement 21. A downhole tool comprising: a sealing element: and a filler with a negative coefficient of thermal expansion (CTE), the filler disposed inside of the sealing element and configured to expand the sealing element during a temperature drop.

Statement 22. The downhole tool of the statement 21, wherein the sealing element is disposed between back-up shoes.

Statement 23. The downhole tool of the statement 21 or the statement 22, wherein the sealing element is disposed between spikes.

Statement 24. A downhole tool comprising an O-ring: and a filler with a negative coefficient of thermal expansion (CTE), the filler disposed inside of the O-ring and configured to expand the O-ring during a temperature drop.

Statement 25. The downhole tool of the statement 24, wherein the O-ring is disposed between spacers.

Although the present disclosure and its advantages have been described in detail, it should be understood that various changes, substitutions, and alterations may be made herein without departing from the spirit and scope of the disclosure as defined by the appended claims. The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A downhole tool comprising:
a spring, comprising:
a first end; and
a second end;
a sealing element adjacent to the first end of the spring and disposed between a first back-up shoe and a second back-up shoe; and
a member adjacent to the second end of the spring,
wherein the member has a negative coefficient of thermal expansion (CTE),
wherein the member is configured to expand the sealing element during a temperature drop, and
wherein the member is external to the sealing element.

2. The downhole tool of claim 1, wherein the member is adjacent to the first back-up shoe.

3. The downhole tool of claim 2, further comprising a spacer that is adjacent to the sealing element.

4. The downhole tool of claim 3, further comprising a wedge adjacent to the member.

5. The downhole tool of claim 4, further comprising a slip adjacent to the wedge.

6. The downhole tool of claim 5, wherein the member extends between the wedge and the first back-up shoe.

7. The downhole tool of claim 6, wherein the member is external to the first back-up shoe and the second back-up shoe.

8. The downhole tool of claim 1, wherein the member includes a shape memory alloy.

9. A downhole tool comprising:
a spring, comprising:
a first end; and
a second end;
a sealing element adjacent to the first end of the spring; and
a member adjacent to the second end of the spring,
wherein the member has a negative coefficient of thermal expansion (CTE),
wherein the member is configured to expand the sealing element during a temperature drop,
wherein the member is external to the sealing element, and
wherein the member includes a spacer.

10. A downhole tool comprising:
a first back-up shoe;
a second back-up shoe;
a first sealing element;
a member with a negative coefficient of thermal expansion (CTE); and
a first spring disposed between the first sealing element and the member,
wherein the member is configured to expand the first sealing element during a temperature drop,
wherein the member includes a shape memory alloy, and
wherein the member includes a second spring.

11. The downhole tool of claim 10, further comprising:
a second sealing element.

12. The downhole tool of claim 11, further comprising:
a spacer disposed between the first sealing element and the second sealing element.

13. The downhole tool of claim 12, wherein:
the first sealing element is disposed adjacent to the first back-up shoe; and
the second sealing element is disposed adjacent to the second back-up shoe.

14. The downhole tool of claim 13, wherein the member is disposed adjacent to the first back-up shoe.

15. A downhole tool comprising:
a first back-up shoe;
a second back-up shoe;
a sealing element;

a member with a negative coefficient of thermal expansion (CTE); and a spring disposed between the sealing element and the member, wherein the member is configured to expand the sealing element during a temperature drop, and wherein the member includes a shape memory alloy.

16. The downhole tool of claim 15, wherein the sealing element is disposed between the first back-up shoe and the second back-up shoe.

17. The downhole tool of claim 16, wherein the member is adjacent to the first back-up shoe.

18. A downhole tool, comprising:

a first back-up shoe;

a second back-up shoe;

a sealing element;

a member with a negative coefficient of thermal expansion (CTE); and a spring disposed between the sealing element and the member, wherein the spring has a positive, wherein the member is configured to expand the sealing element during a temperature drop, and wherein the member includes a shape memory alloy.

19. The downhole tool of claim 18, wherein during the temperature drop:

the spring is configured to contract.

20. The downhole tool of claim 19, wherein the sealing element is configured to expand when the member expands.

* * * * *